US008591261B2

(12) United States Patent
Das et al.

(10) Patent No.: US 8,591,261 B2
(45) Date of Patent: Nov. 26, 2013

(54) ELECTRICAL CONNECTOR HAVING A MAGNETIC ASSEMBLY

(75) Inventors: Jaydip Das, Cupertino, CA (US); Jian Wang, Fremont, CA (US); Na An, Mountain View, CA (US); Randy K. Rannow, Reno, NV (US); Mark W. Ellsworth, Dublin, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 204 days.

(21) Appl. No.: 13/195,356

(22) Filed: Aug. 1, 2011

(65) Prior Publication Data

US 2013/0034996 A1 Feb. 7, 2013

(51) Int. Cl.
*H01R 13/66* (2006.01)

(52) U.S. Cl.
USPC ..... 439/620.05; 439/676

(58) Field of Classification Search
USPC ..... 439/620.05, 620.06, 620.07, 620.09, 439/676
See application file for complete search history.

(56) References Cited

U.S. PATENT DOCUMENTS

| | | | | |
|---|---|---|---|---|
| 6,428,361 | B1 * | 8/2002 | Imschweiler et al. | 439/676 |
| 6,554,638 | B1 * | 4/2003 | Hess et al. | 439/490 |
| 6,811,442 | B1 * | 11/2004 | Lien et al. | 439/620.07 |
| 7,153,163 | B2 | 12/2006 | Lewis et al. | |
| 2004/0242077 | A1 * | 12/2004 | Chang | 439/676 |
| 2007/0015416 | A1 * | 1/2007 | Gutierrez et al. | 439/676 |
| 2011/0053418 | A1 | 3/2011 | Margulis et al. | |
| 2011/0111620 | A1 * | 5/2011 | Lee et al. | 439/488 |

* cited by examiner

*Primary Examiner* — Hae Moon Hyeon

(57) ABSTRACT

An electrical connector includes a housing having a plug cavity configured to receive a modular plug therein. A terminal assembly is coupled to the housing. The terminal assembly has a plurality of terminals configured to engage corresponding terminals of the modular plug. The electronic connector includes a magnetic assembly that has a circuit board. The terminals are terminated to the circuit board. The magnetic assembly has magnetic circuits coupled to the circuit board. Each magnetic circuit has a ferrous portion and conductors circumferentially wrapped around the ferrous portion. At least one of the magnetic circuits is coated with a coating material that includes a matrix and filler. The filler can have a higher or lower dielectric constant than the matrix. The dielectric characteristics of the nano-composite can be tuned by varying the concentrations of the filler and matrix material. This tunable nano-composite can serve as an additional design knob for better impedance matching for the magnetic connectors over a wide frequency range.

20 Claims, 6 Drawing Sheets

ELECTRICAL CONNECTOR HAVING A MAGNETIC ASSEMBLY

BACKGROUND OF THE INVENTION

The subject matter herein relates generally to electrical connectors having magnetic assemblies.

Ethernet connectors, especially of the magnetic variety, are well known in the art. Although connectors of this type were originally intended for use in telecommunications, they have found wide acceptance in a variety of applications. For example, modular jacks are now commercially available as input/output interface connectors for networking applications, e.g., as an Ethernet connector.

When employed as Ethernet connectors, modular jacks generally receive an input signal from one electrical device and then communicate a cleaned up corresponding output signal to a second device coupled thereto. Magnetic circuitry is utilized in the transfer of the input signal of one device to the output signal of the second device and employed as a means of cleaning the input signal during transfer from the first device to the second.

Known Ethernet connectors are not without disadvantages. As Ethernet connectors transmit at higher data rates, such as up to 10 Gbps and higher, the magnetic circuitry is unable to maintain impedance matching and return loss responses within desired limits, leading to distortion or degradation in the data transfer.

A need remains for an electrical connector that uses magnetic isolation circuitry that is capable of data transfer at high data rates with minimal distortion or degradation in the signals.

BRIEF DESCRIPTION OF THE INVENTION

In one embodiment, an electrical connector is provided having a housing that has a plug cavity configured to receive a modular plug therein. A terminal assembly is coupled to the housing. The terminal assembly has a plurality of terminals configured to engage corresponding terminals of the modular plug. The electrical connector includes a magnetic assembly that has a circuit board. Alternatively, a magnetic carrier package may be employed to house the magnetic circuit. The terminals are terminated to the circuit board or magnetics carrier package. The magnetic assembly has magnetic circuits coupled to the circuit board. Each magnetic circuit has a ferrous portion and a conductor circumferentially wrapped around the ferrous portion. At least one of the magnetic circuits is coated with a coating material that includes a matrix and filler. The filler can have a higher or lower dielectric constant than the matrix.

Optionally, the matrix may be silicones, epoxies, polyurethanes, or hybrids thereof. The filler may be metal oxide powders with a dielectric constant higher or lower than the matrix. The filler may be alumina, silica, strontium or barium titanate, or hybrids thereof. The filler may be in the range of 10% to 80% by weight of the composite material. The matrix may be supplied in a liquid or semi-liquid state and the filler may be a nano-powder mixed with the matrix to form the coating material affecting the dielectric properties.

Optionally, the magnetic circuits may include an isolation transformer and a common mode choke, with at least one of the components being coated with the coating material. The coating material may cover the ferrous portion and the conductors. The coating material may be positioned between the conductor windings. The magnetic circuits may be arranged in series and encapsulated, thereby being held together as a core set.

In another embodiment, an electrical connector is provided having a housing that has a plug cavity configured to receive a modular plug therein. A terminal assembly is coupled to the housing. The terminal assembly has a plurality of terminals configured to engage corresponding terminals of the modular plug. The electrical connector includes a magnetic assembly that has a circuit board. The terminals are terminated to the circuit board. The magnetic assembly has magnetic circuits coupled to the circuit board. Each magnetic circuit has a ferrous portion and conductors circumferentially wrapped around the ferrous portion. The magnetic circuits comprise an isolation transformer and a common mode choke. At least one of the components in the magnetic circuit is coated with a coating material that includes a matrix and filler. The filler can have a higher or lower dielectric constant than the matrix. The filler may or may not affect the dielectric strength.

In a further embodiment, an electrical connector is provided having a housing that has a plug cavity configured to receive a modular plug therein. A terminal assembly is coupled to the housing. The terminal assembly has a plurality of terminals configured to engage corresponding terminals of the modular plug. The electrical connector includes a magnetic assembly that has a circuit board. The terminals are terminated to the circuit board. The magnetic assembly has magnetic circuits coupled to the circuit board. Each magnetic circuit has a ferrous portion and conductors circumferentially wrapped around the ferrous portion. At least one of the magnetic circuits is coated with a coating material that includes a matrix and filler. The matrix may be silicone resin, polyurethane, or other epoxy solution and the filler may be alumina, silica or barium titanate nano-powder.

Another embodiment may include a magnetic circuit that has the interconnects adjusted in-situ to enhance or optimize circuit performance prior to setting or curing the matrix. In an exemplary embodiment, the matrix is minimally impacted by further downstream manufacturing processes.

Another embodiment may include the magnetic circuit interconnects coated with the matrix distinctly isolated from other components in the connector module.

Another embodiment may include the magnetic circuit interconnects coated with the matrix to modify the characteristic impedance by changing the dielectric properties and not affecting the geometry of the magnetic circuit.

Another embodiment may include the magnetic circuit interconnects coated with the matrix to modify the thermal characteristics of the magnetic circuit.

DETAILED DESCRIPTION OF THE INVENTION

Figure 1:
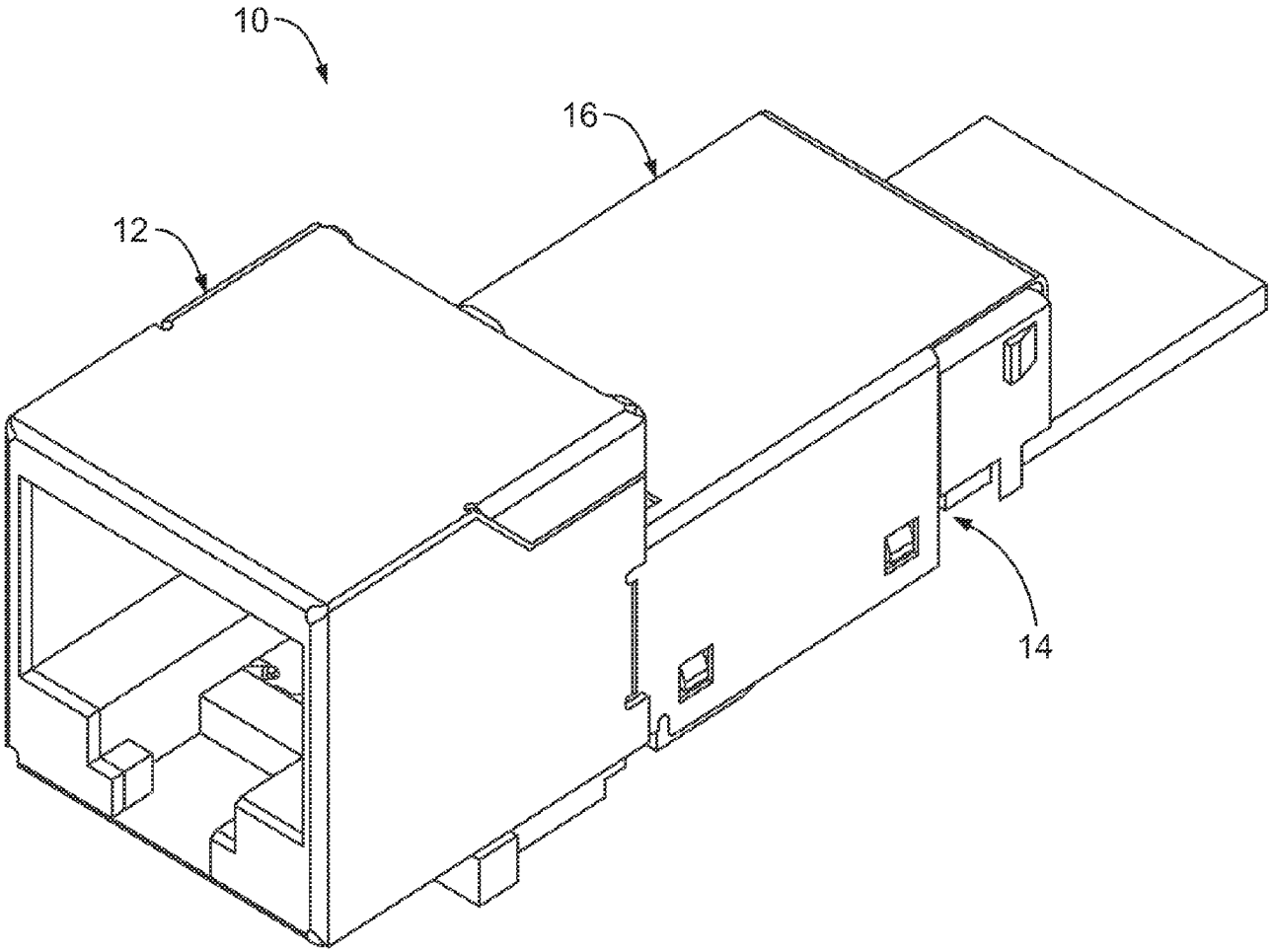
FIG. 1 is a front perspective view of an electrical connector formed in accordance with an exemplary embodiment.

FIG. 1 is a front perspective view of an electrical connector 10 formed in accordance with an exemplary embodiment. In an exemplary embodiment, the electrical connector 10 is a pluggable modular jack with integrated magnetics, such as an Ethernet connector having magnetics. The electrical connector 10 includes a front shield 12, a magnetic assembly 14, and a rear shield 16.

Figure 2:
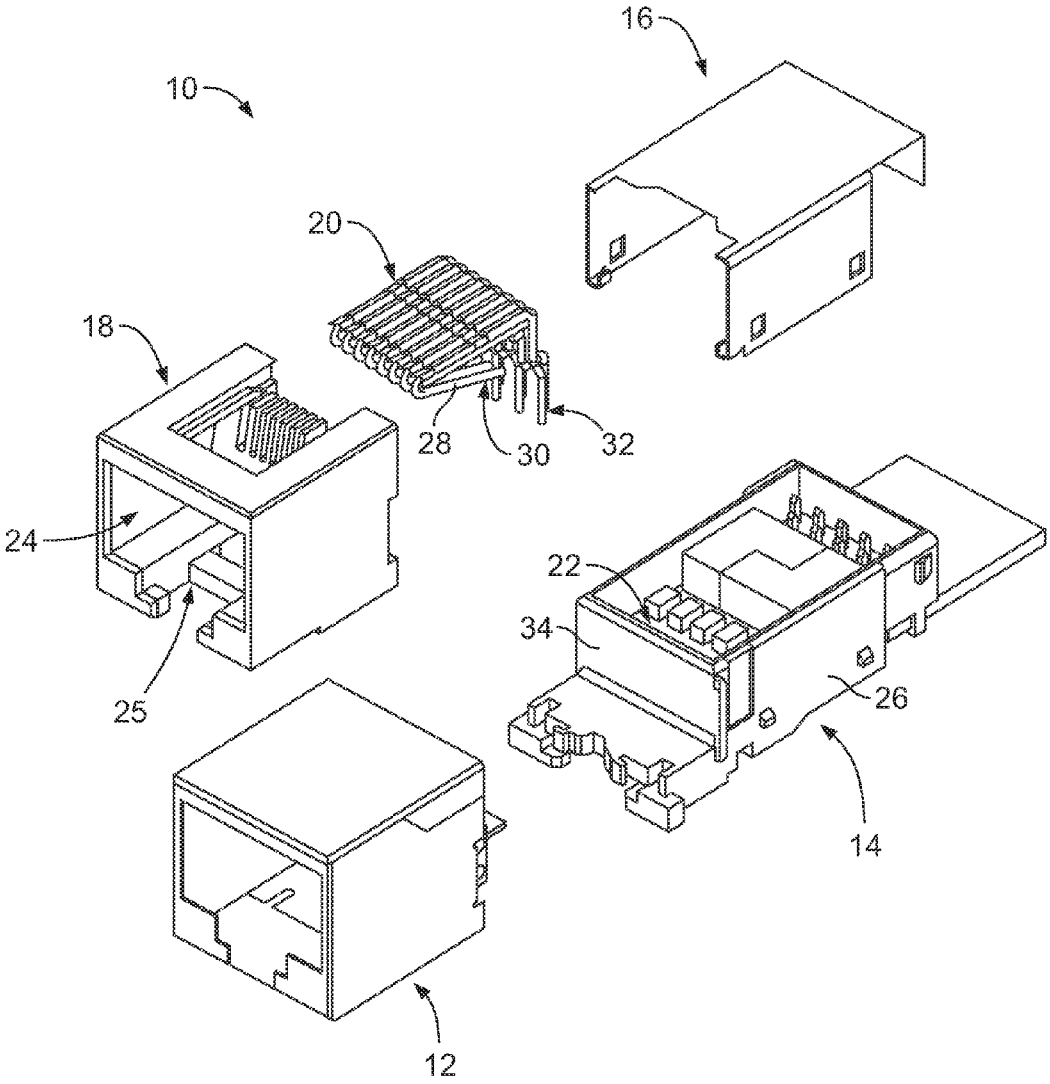
FIG. 2 is an exploded perspective view of the electrical connector shown in FIG. 1.

FIG. 2 is an exploded perspective view of the electrical connector 10. The electrical connector 10 includes a housing 18, a terminal assembly 20, and a printed circuit assembly 22 housed within the magnetic assembly 14. The front and rear shields 12, 16 cover portions of the housing 18 and the magnetic assembly 14. The front and rear shields 12, 16 provide electrical shielding for the terminal assembly 20 and the printed circuit assembly 22.

The housing 18 is manufactured from a dielectric material, such as a plastic material. The housing 18 holds the terminal assembly 20. The housing 18 includes a front opening 24 that is configured to receive a modular plug therein. The front opening 24 is open to a plug cavity 25 that receives the terminal assembly 20 and the modular plug such that the modular plug may be mated to the terminal assembly 20. In the illustrated embodiment, the housing 18 has a substantially cubic shape, however other shapes are possible in alternative embodiments.

The front shield 12 is sized and shaped to surround at least a portion of the housing 18. In the illustrated embodiment, the front shield 12 is substantially cubic in shape, however other shapes are possible in alternative embodiments. The rear shield 16 is sized and shaped to surround at least a portion of the magnetic assembly 14. The rear shield 16 is configured to engage, and be electrically connected, to the front shield 12. In an exemplary embodiment, the magnetic assembly 14 includes a magnetic assembly shield 26 surrounding at least a portion of the magnetic assembly 14. The front shield 12 and/or the rear shield engages and is electrically connected to the magnetic assembly shield 26.

The terminal assembly 20 includes a plurality of terminals 28. The terminals 28 are held by the housing 18 for mating with the modular plug loaded into the plug cavity 25 of the housing 18. The terminals 28 having mating ends 30 configured to mate with corresponding terminals of the modular plug. The mating ends 30 may be angled and deflectable for mating engagement with the terminals of the modular plug. The terminals 28 have mounting ends 32 configured to be terminated to the printed circuit assembly 22. The mounting ends 32 may be through-hole mounted, surface mounted or otherwise electrically connected to the printed circuit assembly 22. The mounting ends 32 may be soldered to the printed circuit assembly 22.

The magnetic assembly 14 includes a magnetic assembly housing 34 that holds the printed circuit assembly 22. The magnetic assembly shield 26 surrounds at least a portion of the magnetic assembly housing 34. In an exemplary embodiment, the magnetic assembly shield 26 is a separate component from the magnetic assembly housing 34. Alternatively, the magnetic assembly housing 34 may be plated or otherwise made conductive to define the magnetic assembly shield 26. The magnetic assembly 14 is configured to be coupled to the housing 18 and/or the front and rear shields 12, 16. Optionally, the magnetic assembly housing 34 may be integral with the housing 18.

Figure 3:
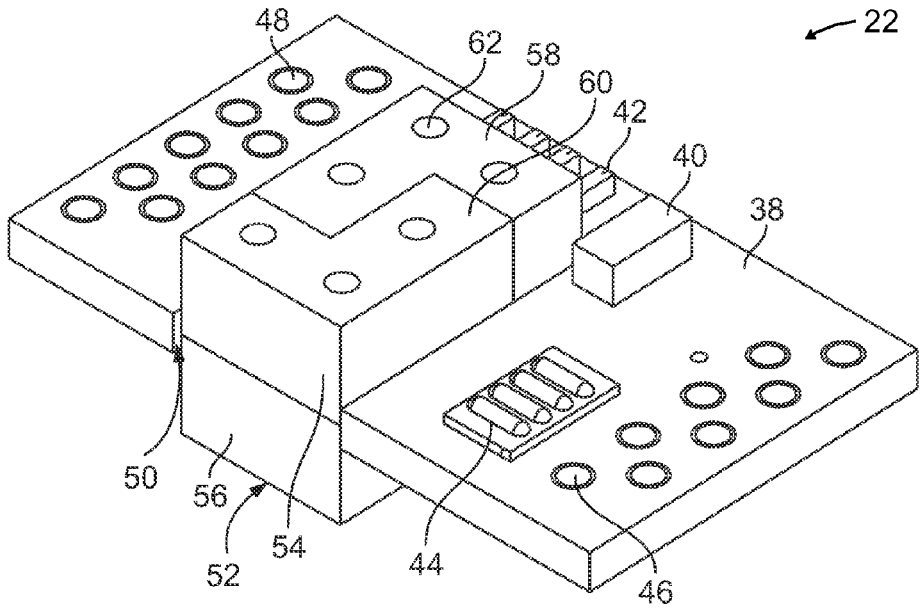
FIG. 3 is a top perspective view of a printed circuit assembly of the electrical connector shown in FIG. 1.

FIG. 3 is a top perspective view of the printed circuit assembly 22. In an exemplary embodiment, the printed circuit assembly 22 includes a circuit board 38, a decoupling capacitor 40, a plurality of capacitors 42, and a plurality of resistors 44. The printed circuit assembly 22 may include other components in alternative embodiments. The circuit board 38 includes a plurality of input contacts 46 and a plurality of output contacts 48. The circuit board 38 includes a circuit board notch 50. The circuit board notch 50 represents an area of the circuit board 38 which has been cut away so as to allow receipt of a coil pack 52. In an alternative embodiment, the coil pack 52 may be mounted to the surface of the circuit board 38 rather than being received in a notch.

The coil pack 52 includes a first encapsulation pair 54 and a second encapsulation pair 56. In an exemplary embodiment, each encapsulation pair 54, 56 includes two core sets 58, 60 and each core set 58, 60 includes three magnetic circuits, represented generally in this figure by way of round circles and indicated by numeral 62. Each encapsulation pair 54, 56 includes six magnetic circuits 62. Any number of encapsulation pairs, core sets and magnetic circuits may be provided in alternative embodiments. In an alternative embodiment, rather than having the magnetic circuits 62 encapsulated, the individual magnetic circuits 62 may be directly mounted to the circuit board 38.

Each encapsulation pair 54, 56 retains the magnetic circuits 62 in positions relative to one another. The encapsulation pairs 54, 56 protect the wires of the magnetic circuits 62 with encapsulation material. The encapsulation material strengthens the durability of the magnetic circuits 62, decreasing the risk of either a short circuit or an open circuit forming therein. The encapsulation provides a robust means of retaining and transporting the magnetic circuits 62 as each magnet is held in a fixed position relative to the others following the encapsulation. The encapsulation material may be any type of encapsulation material, such as a silicone material. Materials other than silicon may be used as the encapsulation material, and the material chosen may include properties allowing the material to perform one or more of the functions outlined above.

The circuit board 38 includes a circuit trace (not shown) on or through the circuit board 38. The circuit trace provides a means of electrically connecting the input contacts 46 with the output contacts 48, whereby electric signals may travel into the input contacts 46, through the circuit trace, and out of the output contacts 48. The decoupling capacitor 40, capacitors 42, and resistors 44 are affixed to circuit board 38 and connected to the circuit trace by any number of methods well known in the art. The core sets 58, 60 are located in the notch 50 and are electrically connected to the circuit trace of the circuit board 38.

Figure 4:
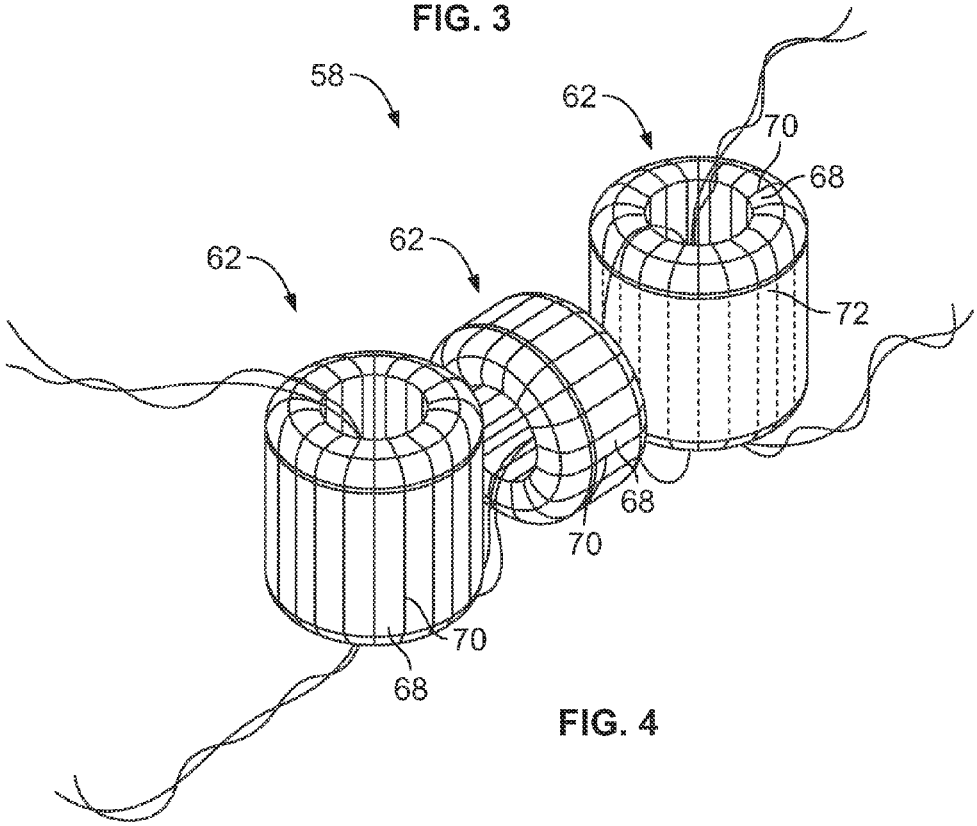
FIG. 4 illustrates a core set for a magnetic assembly of the electrical connector shown in FIG. 1.

FIG. 4 illustrates the core set 58 in which three magnetic circuits 62 are arranged in series. Each magnetic circuit 62 includes a ferrous portion 68 defining a core and one or more conductors or wires 70 being wrapped around the ferrous portion 68 in any manner well known to form windings. The wrapping of the wires 70 forms a twisted pair around the ferrous portion 68 to facilitate the passage of electrical current around the ferrous portion 68 and to create a magnetic flux. Optionally, a single conductor or wire may be wrapped or wound around the ferrous portion 68 with adjacent windings being referred to in the plural as conductors or wires, even though the adjacent windings are the same conductor or wire.

Prior to encapsulation, one or more of the magnetic circuits 62 may be coated with a coating material 72. In the illustrated embodiment, only one of the magnetic circuits 62 is coated with the coating material 72. Other magnetic circuits 62 may be coated in alternative embodiments.

The coating material 72 covers the ferrous portion 68 as well as the wires 70. The coating material 72 may cover all of the ferrous portion 68 and the wires 70. Alternatively, the coating material 72 may cover only a portion of the ferrous portion and the wires 70, such as the outer diameter of the ferrous portion 68 and corresponding portions of the wires 70, such as in the illustrated embodiment. In other embodiments, the coating material 72 may cover the top and the bottom of the ferrous portion 68 and corresponding portions of the wires 70 as well.

The thickness of the coating material 72 may be selected to control electrical characteristics of the magnetic circuit 62. The type of material used as the coating material 72 may be selected to control the electrical characteristics of the magnetic circuit 62. For example, the coating material 72 may be used to improve impedance matching of the magnetic circuit 62. The coating material 72 may be used to enhance return loss performance of the magnetic circuit 62. The coating material may affect other electrical characteristics of the magnetic circuit 62 as well.

In an exemplary embodiment, the coating material 72 is a composite material made from a matrix and a filler having a high dielectric constant. Alternatively, the coating material 72 is a composite material made from a matrix and a filler having a low dielectric constant. The matrix may be liquid or a semi-liquid, such as a paste or a gel. The filler may have a dielectric constant that is significantly higher than the dielectric constant of the matrix. The filler may have a dielectric constant that is between one and one hundred or more times greater than the dielectric constant of the matrix. In alternative embodiments, the matrix may have a dielectric constant that is significantly higher than the dielectric constant of the filler. The matrix material surrounds and supports the filler material and maintains the relative position of the filler material in the matrix. The filler enhances and/or optimizes characteristics, for example the dielectric characteristics, of the coating material 72. The filler concentration can be varied to obtain a specific dielectric characteristic of interest. The coating material 72 may be a composite material of a silicone resin or a polyurethane, or another epoxy solution having alumina or silica or barium titanate nano-powders as a filler. The composite material may be approximately 50% silicone resin solution and 50% barium titanate nano-powder. Other percentage mixtures are possible in alternative embodiments and tailored or tuned to the application-specific requirements. This may include tailoring or tuning the dielectric strength. The tuning or tailoring may be tuning or tailoring of dielectric strength, dielectric constant, and/or thermal performance. The mixture percentage may be calculated by weight, by volume or otherwise and a number of mixing combinations are possible in various embodiments. These embodiments can offer a wide range of dielectric properties ranging from a very low dielectric constant to a very high dielectric constant. Additionally, other matrix or filler materials may be added to the nano-composite mixture to affect the characteristics, such as the dielectric constant, of the composite material. When mixed, the composite material may be a paste that may be applied to the magnetic circuit 62, which may cure or harden after application. Other types of materials may be used as the matrix or the filler to create a composite mixture having particular characteristics that affect the electrical performance of the magnetic circuit 62. The filler may be any metal oxide ceramic material with a variety of dielectric properties, for example, a ferroelectric or a perovskite material. The matrix may be a gel, epoxy, liquid or semi-liquid paste that might serve as an insulation barrier.

The impedance of the magnetic circuit 62 depends, at least in part, on the dielectric constant of the composite coating material 72 that is disposed between individual loops of the wound wires 70. The type of material, placement of the material, thickness of the material and the like can be controlled or tuned to obtain a desired impedance for the magnetic circuit 62. For example, the impedance may be tuned to obtain approximately 100 Ohm impedance over a desired frequency range, such as a frequency range of approximately 1-500 (or more) MHz. The dielectric characteristics of the nano-composite can be tuned by varying the concentrations of the filler and matrix material to serve as an additional design knob for better impedance matching for the magnetic connectors, such as used in 10 Gbps connectors, over a wide frequency range, such as between 1-500 MHz.

Figure 5:
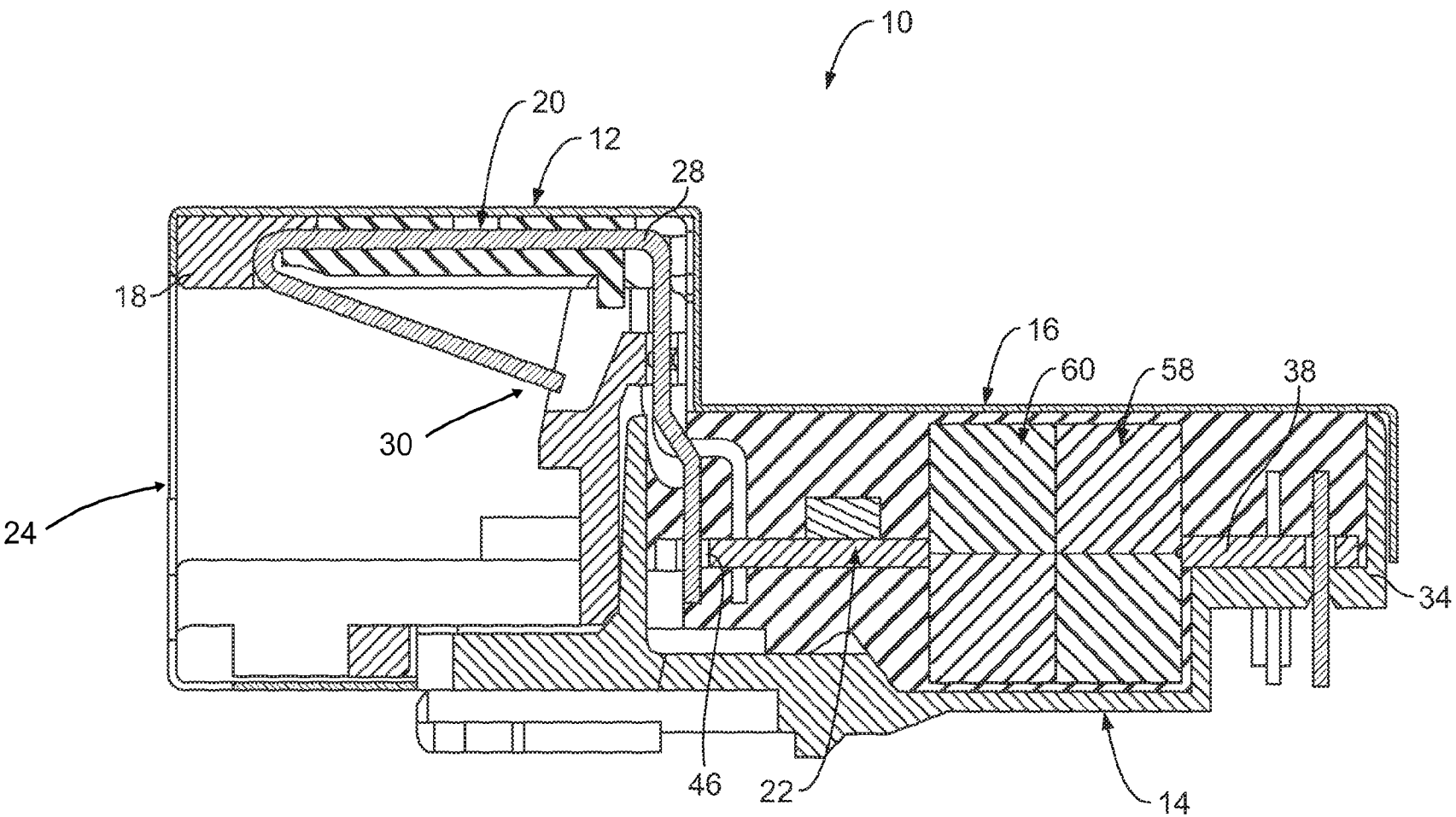
FIG. 5 is a cross-sectional view of the electrical connector shown in FIG. 1.

FIG. 5 is a cross-sectional view of the electrical connector 10. The front and rear shells 12, 16 surround the housing 18, terminal assembly 20 and magnetic assembly 14. The printed circuit assembly 22 is positioned within the magnetic assembly housing 34 and is positioned behind the housing 18. The terminals 28 are held by the housing 18 and extend from the housing 18 to the printed circuit assembly 22. The terminals 28 are terminated to the input contacts 46. The terminals 28 are electrically connected to the core sets 58, 60 by the circuit traces on the circuit board 38. Optionally, the magnetic assembly housing 34 may be filled with potting material around the printed circuit assembly 22 and core sets 58, 60.

Figure 6:
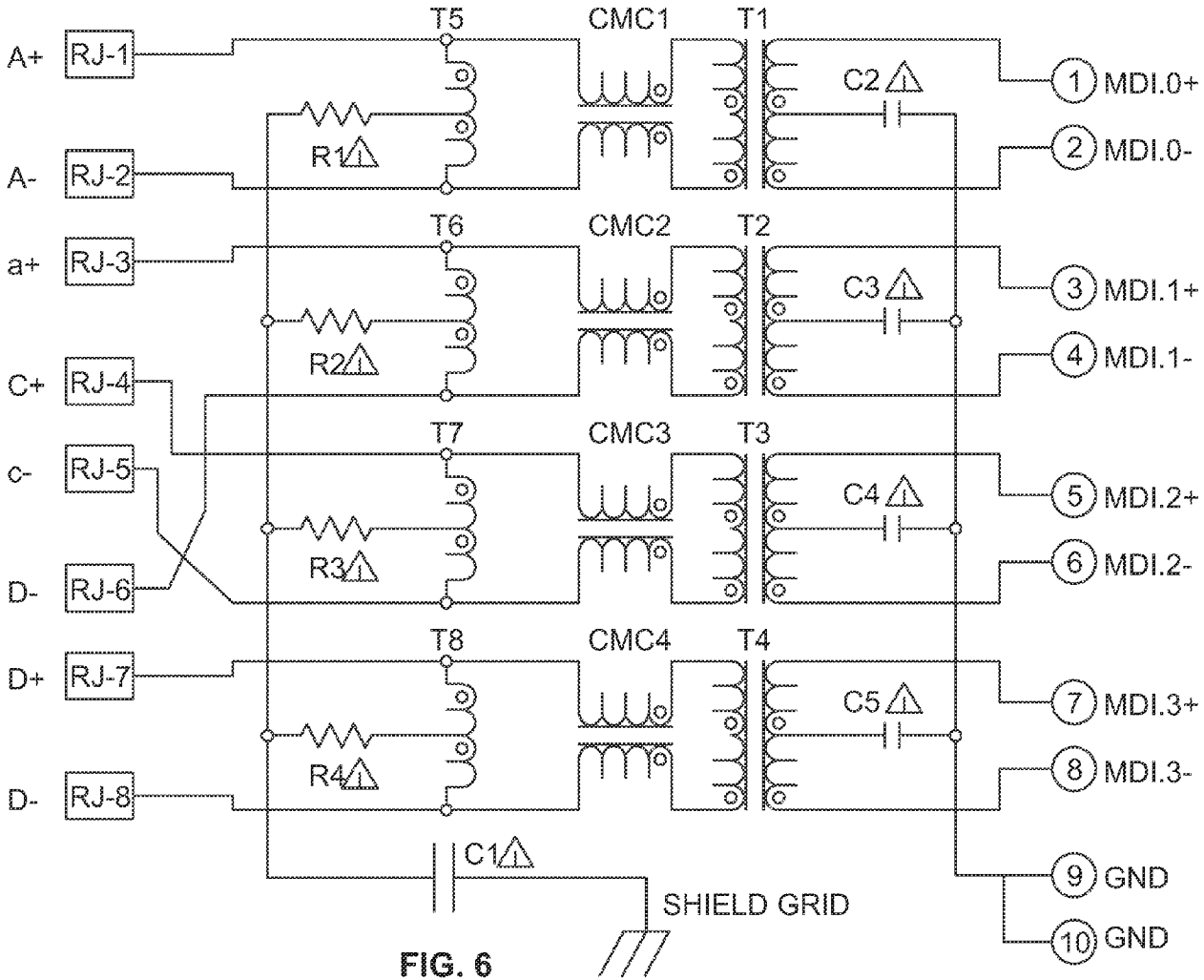
FIG. 6 is a circuit diagram illustrating an exemplary embodiment of a circuit of the printed circuit assembly shown in FIG. 3.

FIG. 6 is a circuit diagram illustrating an exemplary embodiment of a circuit of the printed circuit assembly 22. The input contacts 46 of the circuit board 38 are represented in this diagram by inputs labeled RJ-1 through RJ-8. The output contacts 48 are shown on the right side of the circuit diagram as MDI.0 through MDI.3 and GND 9 and GND 10. The resistors 44 soldered to the printed circuit assembly 22 are represented as R1 through R4. The decoupling capacitor 40 is shown as C1, whereas the other capacitors 42 are depicted as C2 through C5. Each of the channels connecting an input 46 to an output 48 includes three magnetic circuits 62 which are coupled in series. Other arrangements are possible in alternative embodiments. The first magnet circuit in each channel, designated as T5 through T8, respectively, functions as a low impedance, common mode termination to ground. The second magnetic circuit in each series, labeled CMC1 through CMC4, respectively, functions as a common mode choke in the circuit. The third magnetic circuit in each series, designated as T1 through T4, functions as an isolation transformer that provides an output voltage equal to the input voltage, through impedance which cleans up the voltage signal.

Referring now to FIGS. 5 and 6, in operation, a modular plug, such as an Ethernet plug (not shown), is inserted into the electrical connector 10 through the front opening 24. The eight output nodes of the Ethernet plug each engage corresponding angled, deflectable mating ends 30 of the eight terminals 28. In an exemplary embodiment, a common mode circuit is provided and the mating ends 30 receive any output signal generated by the Ethernet plug and transfer the signal through a pair of the terminals 28 to two inputs 46 of the printed circuit assembly 22. The eight inputs 46 correspond to the eight inputs of the circuit diagram depicted in FIG. 6. The signal received by the printed circuit assembly 22 travels through the first magnetic circuit in series with the corresponding twisted pair input. This first magnetic circuit functions as a low impedance, common mode termination to ground allowing a portion of the common signal to be recycled through the shield ground and reducing stray current. The signal passes through the common mode choke, which functions as a 1:1 ratio transformer, and balances the current through the twisted pair of the channel. The signal then travels to the third magnet circuit in the series which functions as an isolation transformer that generates an output voltage substantially equal to the input voltage while also cleaning up the signal. The signal finally travels down the printed circuit to the outputs 48 to which other contacts are coupled and transfers to the mating circuit board or other wires.

In an exemplary embodiment, the third magnetic circuit, the isolation transformer, in each series can be coated with the coating material 72 (shown in FIG. 4) to improve the impedance matching and/or the return loss performance of the isolation transformer. By tuning the isolation transformer using the coating material 72, the circuit may provide a high speed connector having enhanced performance across a wide frequency range.

Figure 7:
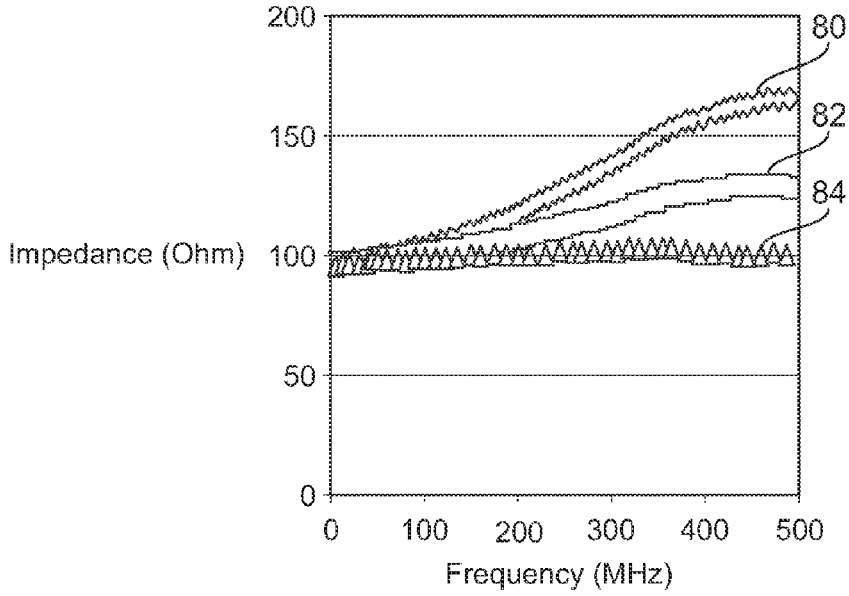
FIG. 7 is a graph showing impedance profiles of different magnetic circuits of the magnetic assembly.

FIG. 7 is a graph showing impedance profiles of different magnetic circuits. The graphs show the impedance as a function of the frequency for an uncoated magnetic circuit 80, an un-enhanced, coated magnetic circuit 82 (e.g. a magnetic circuit coated with a matrix material without any filler) and an enhanced, coated magnetic circuit 84 (e.g. a magnetic circuit coated with the coating material 72, such as a composite mixture of approximately 50% silicone resin solution and 50% barium titanate nano-powder).

For the uncoated magnetic circuit 80, the impedance tends to deviate from the desired 100 Ohm impedance as the frequency increases. Similarly, for the un-enhanced, coated magnetic circuit 82, the impedance tends to deviate from the desired 100 Ohm impedance as the frequency increases, however to a lesser extent than the uncoated magnetic circuit 80. For the enhanced, coated magnetic circuit 84, the impedance does not deviate much, if at all, from the desired 100 Ohm impedance as the frequency increases. The frequency range illustrated is between 1-500 MHz. The enhanced, coated magnetic circuit 84 maintains the desired 100 Ohm impedance from 1-500 MHz and beyond. The electrical connector 10 utilizing magnetic circuits that are coated with the coating material 72 is configured to perform well at high data rates due, in part, to the coating material 72 enhancing the magnetic circuits 84.

Figure 8:
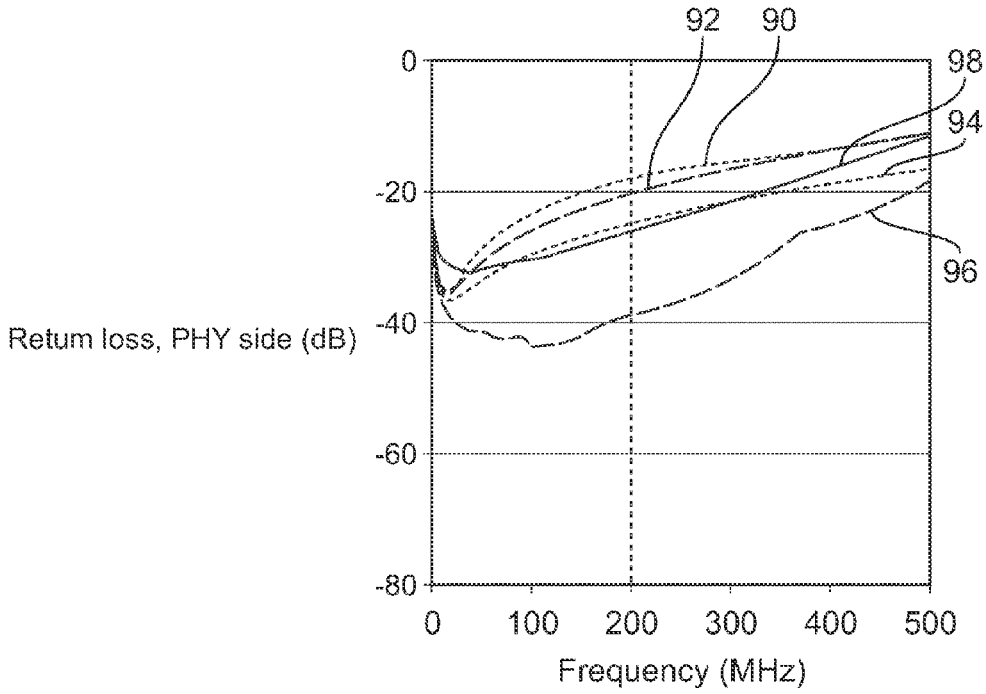
FIG. 8 is a graph showing return loss profiles of different magnetic circuits of the magnetic assembly.

FIG. 8 is a graph showing return loss profiles of different magnetic circuits. The graph shows the return loss response results, at the output side of the printed circuit assembly, for two samples (e.g. sample 1 and sample 2) of magnetic circuits before and after coating. Sample one is coated with a matrix material without any filler. Sample two is coated with the coating material 72, such as a composite mixture of approximately 50% silicone resin solution and 50% barium titanate nano-powder.

The return loss response results for the uncoated sample one is indicated by reference numeral 90, the return loss response results for the uncoated sample two is indicated by reference numeral 92. The return loss response results for the un-enhanced, coated sample one is indicated by reference numeral 94, the return loss response results for the enhanced, coated sample two is indicated by reference numeral 96. A limit line 98 indicating a possible return loss limit across the plotted frequency range is plotted in the graph of FIG. 8. The limit line may vary depending on the particular application and end result.

The graph shows that the return loss response is the lowest for the coated sample two 96 and the return loss response of the coated sample two 96 is below the loss limit line 98 over the entire frequency range, which in the graph is 1-500 MHz. For the uncoated samples 90, 92, the return loss responses were well above the limit line 98. Even though coating the magnetic circuit(s) 62 with the un-enhanced coating, such as just the matrix solution, helps to improve the performance of the magnetic circuit(s) 62, the return loss responses do fall outside of the loss limit for part of the frequency range of interest. As an example, at 200 MHz, the return loss for the uncoated samples 90, 92 are in the −18 to −20 dB range, while for the un-enhanced coated sample 94, the return loss is about −24 dB, which is above the loss limit, and hence unacceptable at such frequency. For the enhanced, coated sample 96, the return loss is about −38 dB at 200 MHz which is about 14 dB lower than the un-enhanced, coated sample 94.

Having the coating material 72 applied to the magnetic circuit(s) 62 improves the impedance matching and the return loss response, enhancing the performance of the electrical connector 10. The coating material 72 provides a better dielectric characteristic between the loops of the wires 70, which enhances the performance of the electrical connector 10 beyond that of simply applying a matrix material solution to the magnetic circuit(s) 62 or simply encapsulating the magnetic circuits 62. Different embodiments may utilize different coating materials 72 having different dielectric properties, allowing the capability of tuning the performance of the electrical connector 10 during manufacture such that one circuit design can be tailored or tuned by materials of the coating material 72 to meet various electrical performance requirements.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a plug cavity configured to receive a modular plug therein;

a terminal assembly coupled to the housing, the terminal assembly having a plurality of terminals configured to engage corresponding terminals of the modular plug;

a magnetic assembly having a circuit board, the terminals being terminated to the circuit board, the magnetic assembly having magnetic circuits coupled to the circuit board, each magnetic circuit having a ferrous portion and conductors circumferentially wrapped around the ferrous portion, at least one of the magnetic circuits being coated with a composite coating material comprising a matrix and filler, the filler having one of a higher or lower dielectric constant than the matrix.

2. The electrical connector of claim 1, wherein the matrix is an epoxy solution.

3. The electrical connector of claim 1, wherein the filler is a ferroelectric ceramic material.

4. The electrical connector of claim 1, wherein the matrix is an epoxy solution and the filler is one of an alumina, silica or ferroelectric ceramic nano-powder material.

5. The electrical connector of claim 1, wherein the matrix and the filler content can be varied in the 10-80% range to form the composite material with a particular dielectric characteristic.

6. The electrical connector of claim 1, wherein the composition of the composite material is selected to tune the magnetic circuits to application specific performance requirements.

7. The electrical connector of claim 1, wherein the coating material covers the ferrous portion and the conductors.

8. The electrical connector of claim 1, wherein the coating material is positioned between loops of the conductors.

9. The electrical connector of claim 1, wherein the magnetic circuits are arranged in series and encapsulated, thereby being held together as a core set.

10. An electrical connector comprising:

a housing having a plug cavity configured to receive a modular plug therein;

a terminal assembly coupled to the housing, the terminal assembly having a plurality of terminals configured to engage corresponding terminals of the modular plug;

a magnetic assembly having a circuit board, the terminals being terminated to the circuit board, the magnetic assembly having magnetic circuits coupled to the circuit board, each magnetic circuit having a ferrous portion and a conductors circumferentially wrapped around the ferrous portion, the magnetic circuits comprising an isolation transformer and a common mode choke, at least one of the isolation transformer and the common mode choke being coated with a coating material comprising a matrix and filler, the filler having one of a higher or lower dielectric constant than the matrix.

11. The electrical connector of claim 10, wherein the matrix is an epoxy solution.

12. The electrical connector of claim 10, wherein the filler is one of an alumina, silica or ferroelectric ceramic material.

13. The electrical connector of claim 10, wherein the matrix is an epoxy solution and the filler is a ferroelectric ceramic nano-powder material.

14. The electrical connector of claim 10, wherein the coating material covers the ferrous portion and the conductors.

15. The electrical connector of claim 10, wherein the coating material is positioned between loops of the conductors.

16. An electrical connector comprising:

a housing having a plug cavity configured to receive a modular plug therein;

a terminal assembly coupled to the housing, the terminal assembly having a plurality of terminals configured to engage corresponding termininals of the modular plug;

a magnetic assembly having a circuit board, the terminals being terminated to the circuit board, the magnetic assembly having magnetic circuits coupled to the circuit board, each magnetic circuit having a ferrous portion and conductors circumferentially wrapped around the ferrous portion, at least one of the magnetic circuits being coated with a coating material comprising a matrix and filler, the matrix being an epoxy solution and the filler being a ferroelectric ceramic nano-powder.

17. The electrical connector of claim 16, wherein the matrix and the filler are each approximately 50% by weight of the composite material.

18. The electrical connector of claim 16, wherein the magnetic circuits comprise an isolation transformer and a common mode choke, at least one of the isolation transformer and the common mode choke being coated with the coating material.

19. The electrical connector of claim 16, wherein the coating material is positioned between loops of the conductors.

20. The electrical connector of claim 16, wherein the conductors are positioned with respect to the ferrous portion to provide tuning or tailoring of dielectric strength, dielectric constant, and thermal performance.

* * * * *